US006910416B2

(12) United States Patent
Conzelmann et al.

(10) Patent No.: US 6,910,416 B2
(45) Date of Patent: Jun. 28, 2005

(54) SUCTION GUIDANCE DEVICE FOR A SINGLE-DRUM TURNER

(75) Inventors: Daniel Conzelmann, Dielheim (DE); Gerhard Heppenstiel, Bammental (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 7 days.

(21) Appl. No.: 10/735,234

(22) Filed: Dec. 12, 2003

(65) Prior Publication Data

US 2004/0123757 A1 Jul. 1, 2004

(30) Foreign Application Priority Data

Dec. 12, 2002 (DE) ..... 102 58 002
Sep. 1, 2003 (DE) ..... 103 40 171

(51) Int. Cl.[7] ..... B41F 21/10; B41F 21/00; B65H 5/22

(52) U.S. Cl. ..... 101/232; 101/230; 101/142; 271/276

(58) Field of Search ..... 101/230, 232, 101/142; 271/276, 264

(56) References Cited

U.S. PATENT DOCUMENTS 4,493,255 A * 1/1985 Fischer ..... 101/183
6,089,156 A * 7/2000 Stephan ..... 101/230
6,662,722 B2 * 12/2003 Frankenberger et al. .... 101/232
6,729,233 B2 * 5/2004 Knopp et al. ..... 101/232

FOREIGN PATENT DOCUMENTS

| | | | | |
|---|---|---|---|---|
| DE | 44 24 968 C2 | | 1/1996 | |
| DE | 19638311 A1 | * | 5/1997 | ..... B41F/21/10 |
| DE | 199 52 205 C1 | | 12/2000 | |
| DE | 100 00 510 A1 | | 7/2001 | |
| DE | 201 01 835 U1 | | 7/2001 | |
| EP | 1 124 689 B1 | | 8/2001 | |
| JP | 2002264301 A | | 9/2002 | |

* cited by examiner

*Primary Examiner*—Daniel J. Colilla
(74) *Attorney, Agent, or Firm*—Laurence A. Greenberg; Werner H. Stemer; Ralph E. Locher

(57) ABSTRACT

In the region of a turner device in a sheet processing machine, a sheet-guiding device is disposed at a great spacing from the turner drum on the other side of a common tangent between a turner drum and a transfer drum.

13 Claims, 3 Drawing Sheets

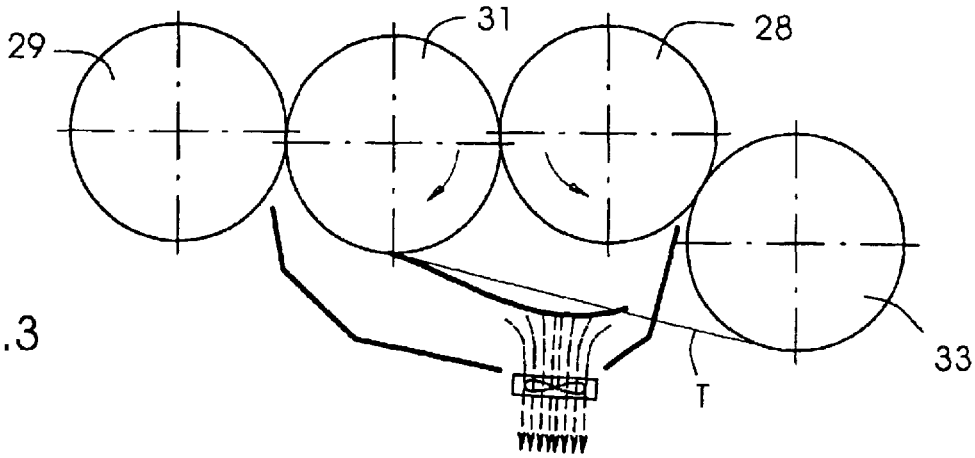
Fig.3
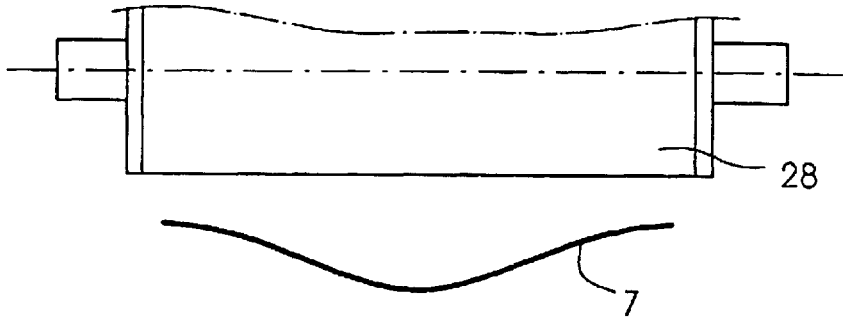
Fig.4
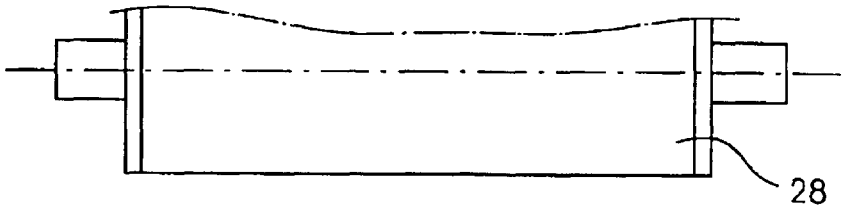
Fig.5
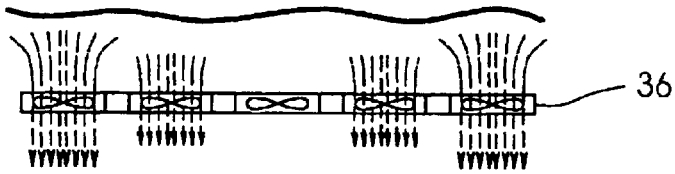
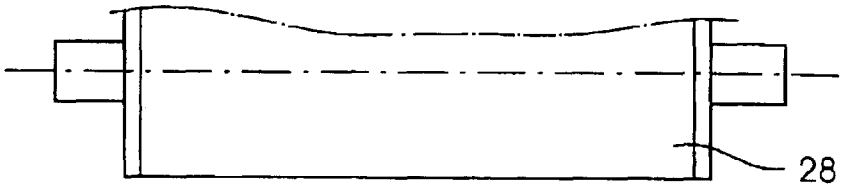
Fig.6
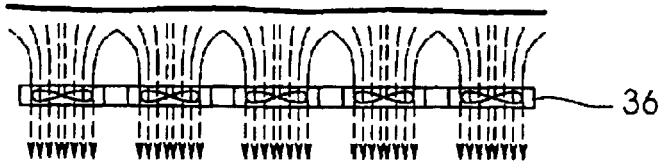

SUCTION GUIDANCE DEVICE FOR A SINGLE-DRUM TURNER

BACKGROUND OF THE INVENTION

Field of the Invention

A sheet-guiding device for sheets of a sheet processing machine, in particular, in the region of a turner device, in which the sheet is accepted from an upstream impression cylinder, turned by a turner drum and transferred to a following impression cylinder.

Particularly in a single-drum turner device, lightweight grammages tend toward a very unstable sheet run in the storage region and, therefore, below the turner drum at relatively high printing speeds in turning operation, which can lead to the undesirable formation of folds and bending in the sheet or the grammage and, thus, impairs the quality.

German Patent DE 44 24 968 C2 has already disclosed a sheet-guiding device that is disposed below the turner drum and can be acted on pneumatically. In this document, it is intended that the sheet be drawn against a guide plate of the sheet-guiding device by the application of vacuum, for example.

SUMMARY OF THE INVENTION

It is accordingly an object of the invention to provide a suction guidance device for a single-drum turner that overcomes the hereinafore-mentioned disadvantages of the heretofore-known devices of this general type and that, in the region of the turner drum, in particular, in a single-drum turner device, does not come into contact with the turned sheet.

With the foregoing and other objects in view, in a sheet processing machine for processing sheets, the sheet processing machine having a turner device with a storage drum and a turner drum, a transfer drum disposed upstream of the turner device in a sheet transport direction, the transfer drum and the turner drum defining a common tangent extending from the transfer drum to the turner drum and having respective axes, there is provided, in accordance with the invention, a sheet-guiding device including at least one suction device being disposed in a region below the storage drum, in a region of the turner device, and on a side of the common tangent opposite the axes, the suction device having a configuration of suction fans disposed in a row next to one another, the suction fans being regulated as a function of at least one of the sheet to be processed and the sheet processing speed.

It is a particular advantage of the invention that the sheet-guiding device according to the invention is disposed at a great spacing from the sheet-guiding drums and cylinders. Such a measure ensures that the grammages (also referred to as grams per unit area) or sheets to be turned do not come into contact with the sheet-guiding device. It is of particular advantage here that the sheet-guiding device produces a pneumatic application of negative pressure in the rear region of the sheet, in particular, in the phase while the sheet is being detached from and pulled off the preceding cylinder, and produces a pneumatic application of positive pressure (e.g., blown air) in the front region. Such measures ensure that the rear sheet region is pulled rapidly downward away from the impression cylinder or the storage drum, while the blower devices ensure that there is no contact between the sheet and sheet-guiding device.

In accordance with another feature of the invention, the sheet-guiding device has an extent transverse with respect to the sheet transport direction approximately equal to a width of a cylinder.

In accordance with a further feature of the invention, the storage drum has a first width and the turner drum has a second width and the suction device has an extent transverse with respect to the sheet transport direction approximately equal to a width of the first width and/or the second width.

In accordance with an added feature of the invention, the storage drum and the turner drum has a width and the suction device has an extent transverse with respect to the sheet transport direction approximately equal to the width of the storage drum and the turner drum.

In accordance with an additional feature of the invention, the sheet processing machine has an impression cylinder disposed downstream of the turner device with respect to the sheet transport direction, the storage drum is a impression cylinder/storage drum, the impression cylinder/storage drum and the upstream transfer drum define a common transfer gap therebetween, and the sheet-guiding device has an extent in the sheet transport direction extending at least from the downstream impression cylinder to the common transfer gap.

In accordance with yet another feature of the invention, the sheet processing machine has an impression cylinder disposed downstream of the turner device with respect to the sheet transport direction and the sheet-guiding device has an extent in the sheet transport direction extending at least from the downstream impression cylinder to the adjacent upstream transfer drum.

In accordance with yet a further feature of the invention, the sheet processing machine has a cylinder disposed downstream of the turner device with respect to the sheet transport direction, and at least one blower device is disposed in a region below the turner drum and/or the downstream cylinder, in particular, an impression cylinder.

In accordance with yet an added feature of the invention, the blower device has at least one row of blowing fans disposed transversely with respect to the sheet transport direction.

In accordance with yet an additional feature of the invention, the blowing fans are regulated as a function of at least one of the sheet to be processed and the sheet processing speed.

With the objects of the invention in view, there is also provided a In a sheet processing machine for processing sheets, the sheet processing machine having a turner device with a storage drum and a turner drum, a transfer drum disposed upstream of the turner device in a sheet transport direction, a cylinder disposed downstream of the turner device with respect to the sheet transport direction, the transfer drum and the turner drum defining a common tangent extending from the transfer drum to the turner drum and having respective axes, a sheet-guiding device including at least one suction device disposed in a region below the storage drum, in a region of the turner device, and on a side of the common tangent opposite the axes, the suction device having a configuration of suction fans disposed in a row next to one another, the suction fans being regulated as a function of at least one of the sheet to be processed and the sheet processing speed, and at least one blower device disposed in a region below the turner drum and/or the downstream cylinder.

With the objects of the invention in view, there is also provided a printing press for processing sheets in a sheet transport direction at a processing speed, including a turner device with a storage drum and a turner drum, a transfer drum disposed upstream of the turner device in the sheet transport direction, the transfer drum and the turner drum defining a common tangent extending from the transfer drum to the turner drum and having respective axes, and a sheet-guiding device having at least one suction device disposed in a region below the storage drum, in a region of the turner device, and on a side of the common tangent opposite the axes, the suction device having a configuration of suction fans disposed in a row next to one another, the suction fans being regulated as a function of at least one of the sheet to be processed and the sheet processing speed.

With the objects of the invention in view, in a sheet processing machine for processing sheets, the sheet processing machine having a turner device with a storage drum and a turner drum, a transfer drum disposed upstream of the turner device in a sheet transport direction, the transfer drum and the turner drum defining a common tangent extending from the transfer drum to the turner drum and having respective axes, there is also provided a pneumatically actuated sheet-guiding device including at least one suction device being disposed in a region below the storage drum, in a region of the turner device, and on a side of the common tangent opposite the axes, the suction device having a configuration of suction fans disposed in a row next to one another, the suction fans being regulated as a function of at least one of the sheet to be processed and the sheet processing speed.

One exemplary embodiment of the invention is shown in the drawings and described in detail in the following text.

Other features that are considered as characteristic for the invention are set forth in the appended claims.

Although the invention is illustrated and described herein as embodied in a suction guidance device for a single-drum turner, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 3 is a cross-sectional view of the sheet-guiding device of FIG. 1 with a suction device;

FIG. 4 is a fragmentary, plan view of the storage drum of FIG. 1 with a sheet but without a guiding device;

FIG. 5 is a fragmentary, plan view of the storage drum of FIG. 1 with a guiding device and a lightweight grammage or thin sheet according to the invention; and FIG. 6 is a fragmentary, plan view of the storage drum of FIG. 1 with a guiding device and a heavyweight grammage or thick sheet.

DESCRIPTION OF THE PREFERRED EMBODIMENTS

Figure 1:
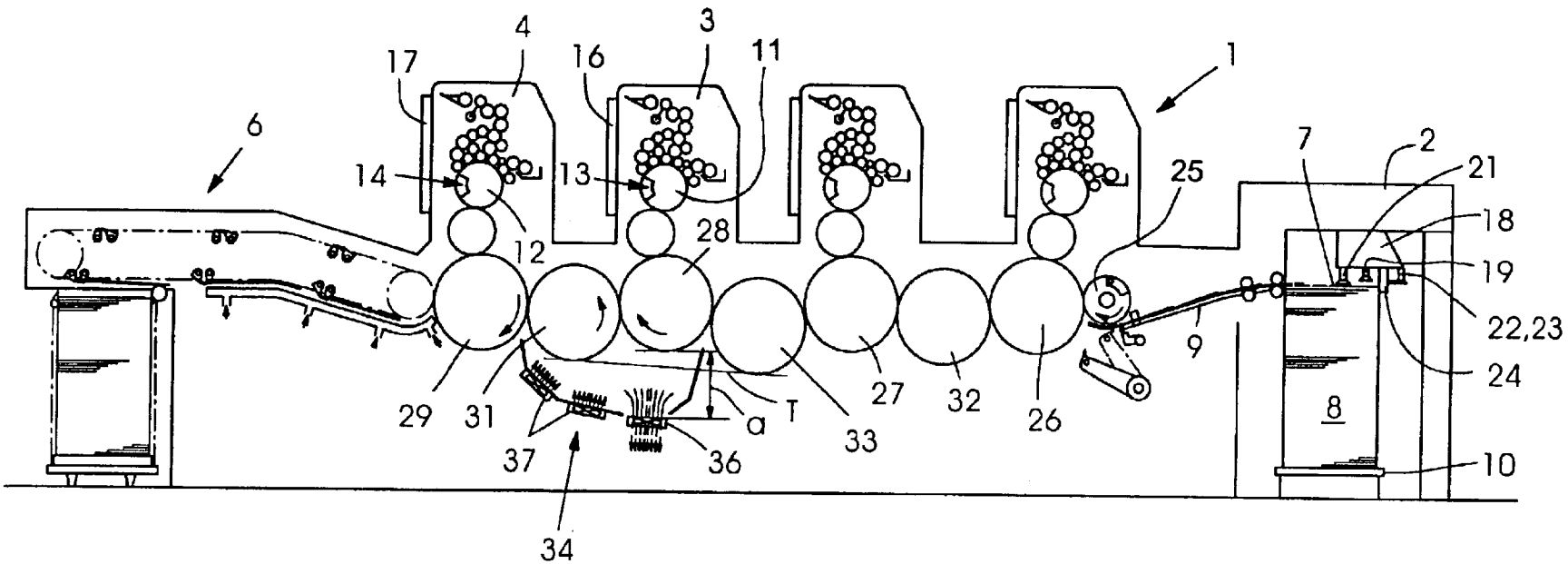
FIG. 1 is a cross-sectional view of a sheet-fed rotary press according to the invention.

Referring now to the figures of the drawings in detail and first, particularly to FIG. 1 thereof, there is shown a rotary press, e.g., a printing press that processes sheets 7, has a feeder 2, at least one printing unit 3 or 4, in the exemplary embodiment 4, and a delivery 6. The sheets 7 are taken from a sheet stack 8 and, separated or overlapped, are fed over a feed table 9 to the printing units 3 and 4. The latter each contain a plate cylinder 11, 12 in a known manner. The plate cylinders 11, 12 each have a device 13, 14 for fastening flexible printing plates. Furthermore, each plate cylinder 11, 12 has a device 16, 17 for semiautomatic or fully automatic printing plate change.

The sheet stack 8 lies on a stack plate 10 which can be raised under control. The removal of the sheets 7 takes place from the top of the sheet stack 8 by a suction head 18, as it is known, which, inter alia, has a number of lifting and dragging suckers 19, 21 to separate the sheets 7. Furthermore, blower devices 22 for loosening the top sheet layers and sensing elements 23 for tracking the stack are provided. To align the sheet stack 8, in particular, the top sheets 7 of the sheet stack 8, a number of side and rear stops 24 are provided.

Figure 2:
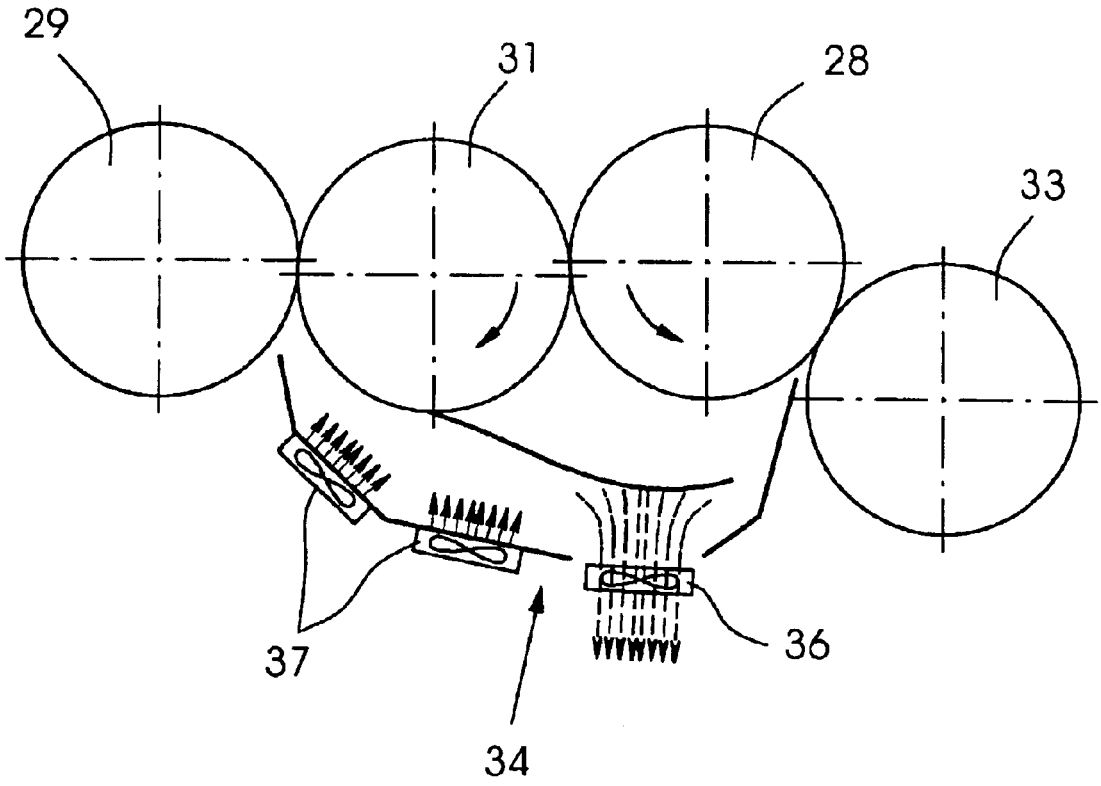
FIG. 2 is a cross-sectional view of the sheet-guiding device of FIG. 1 with a suction and blower device.

A feed cylinder 25, the impression cylinders 26, 27, 28, 29, a sheet transfer drum, configured as a convertible turner drum 31, and transfer drums 32, 33 disposed between the impression cylinders ensure transport of the sheets through the printing press in recto printing and turning of the sheet in the region of the turner device. All the cylinders are disposed vertically offset from the respective adjacent cylinder. In particular, in the region of the turner drum 31 as part of a single-drum turner device, a sheet-guiding device 34 which can be acted on pneumatically is provided below the turner drum 31 (see the enlarged details of various embodiments in FIGS. 2 and 3). The sheet-guiding device 34 extends transversely with respect to the sheet running direction across the cylinder width and, as seen in the sheet transport direction, from the downstream impression cylinder 29 to the transfer gap between the upstream impression cylinder/storage drum 28 and the transfer drum 33. The sheet-guiding device 34 has a curved profile here as seen in the sheet transport direction. There is provision here for a suction device 36 extending transversely with respect to the sheet transport direction, for example, with at least one suction fan, to be disposed in a storage region of the sheet to be turned, that is to say, below the impression cylinder/storage drum 28.

The suction device 36 has the function of assisting the rapid lowering of the turned sheet from the impression cylinder/storage drum 28 so that the rear sheet half is guided in tautened form to the following impression cylinder 29 on a relatively long, non-straight path and excess kinetic energy is, thus, dissipated. In order, however, that the sheet does not touch the sheet-guiding device 34 in any circumstances, the latter is disposed at a great spacing a from the cylinders 28, 31. According to the invention, the sheet-guiding device 34 is situated on the other side of a common tangent T between the transfer drum 33 and impression cylinder 29. In its front region, the sheet-guiding device 34 has at least one blown air device 37, for example, a fan, which applies blown air to the sheet from below so that the sheet does not come into contact with the sheet-guiding device 34. The blower device 37 is, preferably, a configuration of fans disposed next to one another in a row and transversely with respect to the sheet transport direction. It is also possible here to provide a number of rows of fans. Both the vacuum fans 36 and the blown air fans 37 can be regulated as a function of the grammage to be processed and the sheet processing speed.

Lightweight grammages generally tend to sag in the middle in a V-shaped manner (as shown in FIG. 4), i.e., the lateral sheet regions are situated above the central regions of the sheet.

By selectively activating the lateral regions and appropriately applying vacuum thereto, as shown in FIG. 5, the lateral regions of the sheet are drawn down to the level of the center. On the other hand, heavier sheets, such as board, can have vacuum applied uniformly to them, as shown in FIG. 6, as they tend to sag to a lesser extent.

We claim:

1. In a sheet processing machine for processing sheets, the sheet processing machine having a turner device with a storage drum and a turner drum, a transfer drum disposed upstream of the turner device in a sheet transport direction, the transfer drum and the turner drum defining a common tangent extending from the transfer drum to the turner drum and having respective axes, a sheet-guiding device comprising:

at least one suction device being disposed in a region below the storage drum, in a region of the turner device, and on a side of the common tangent opposite the axes, said suction device having a configuration of suction fans disposed in a row next to one another, said suction fans being regulated as a function of at least one of the sheet to be processed and the sheet processing speed.

2. The sheet-guiding device according to claim 1, wherein the sheet-guiding device has an extent transverse with respect to the sheet transport direction approximately equal to a width of a cylinder.

3. The sheet-guiding device according to claim 1, wherein:

the storage drum has a first width and the turner drum has a second width; and said suction device has an extent transverse with respect to the sheet transport direction approximately equal to a width of one of the group consisting of the first width and the second width.

4. The sheet-guiding device according to claim 1, wherein:

the storage drum and the turner drum has a width; and said suction device has an extent transverse with respect to the sheet transport direction approximately equal to the width of the storage drum and the turner drum.

5. The sheet-guiding device according to claim 1, wherein:

the sheet processing machine has an impression cylinder disposed downstream of the turner device with respect to the sheet transport direction;

the storage drum is a impression cylinder/storage drum;

the impression cylinder/storage drum and the upstream transfer drum define a common transfer gap therebetween; and the sheet-guiding device has an extent in the sheet transport direction extending at least from the downstream impression cylinder to the common transfer gap.

6. The sheet-guiding device according to claim 1, wherein:

the sheet processing machine has an impression cylinder disposed downstream of the turner device with respect to the sheet transport direction; and the sheet-guiding device has an extent in the sheet transport direction extending at least from the downstream impression cylinder to the adjacent upstream transfer drum.

7. The sheet-guiding device according to claim 1, wherein:

the sheet processing machine has a cylinder disposed downstream of the turner device with respect to the sheet transport direction; and at least one blower device is disposed in a region below at least one of the group consisting of the turner drum and the downstream cylinder.

8. The sheet-guiding device according to claim 1, wherein the downstream cylinder is an impression cylinder.

9. The sheet-guiding device according to claim 7, wherein said blower device has at least one row of blowing fans disposed transversely with respect to the sheet transport direction.

10. The sheet-guiding device according to claim 9, wherein said blowing fans are regulated as a function of at least one of the sheet to be processed and the sheet processing speed.

11. In a sheet processing machine for processing sheets, the sheet processing machine having a turner device with a storage drum and a turner drum, a transfer drum disposed upstream of the turner device in a sheet transport direction, a cylinder disposed downstream of the turner device with respect to the sheet transport direction, the transfer drum and the turner drum defining a common tangent extending from the transfer drum to the turner drum and having respective axes, a sheet-guiding device comprising:

at least one suction device disposed in a region below the storage drum, in a region of the turner device, and on a side of the common tangent opposite the axes, said suction device having a configuration of suction fans disposed in a row next to one another, said suction fans being regulated as a function of at least one of the sheet to be processed and the sheet processing speed; and at least one blower device disposed in a region below at least one of the group consisting of the turner drum and the downstream cylinder.

12. A printing press for processing sheets in a sheet transport direction at a processing speed, comprising:

a turner device with a storage drum and a turner drum;

a transfer drum disposed upstream of said turner device in the sheet transport direction, said transfer drum and said turner drum defining a common tangent extending from said transfer drum to said turner drum and having respective axes; and a sheet-guiding device having:

at least one suction device disposed in a region below said storage drum, in a region of said turner device, and on a side of said common tangent opposite said axes, said suction device having a configuration of suction fans disposed in a row next to one another, said suction fans being regulated as a function of at least one of the sheet to be processed and the sheet processing speed.

13. In a sheet processing machine for processing sheets, the sheet processing machine having a turner device with a storage drum and a turner drum, a transfer drum disposed upstream of the turner device in a sheet transport direction, the transfer drum and the turner drum defining a common tangent extending from the transfer drum to the turner drum and having respective axes, a pneumatically actuated sheet-guiding device comprising:

at least one suction device being disposed in a region below the storage drum, in a region of the turner device, and on a side of the common tangent opposite the axes, said suction device having a configuration of suction fans disposed in a row next to one another, said suction fans being regulated as a function of at least one of the sheet to be processed and the sheet processing speed.

* * * * *